United States Patent [19]

Blot

[11] Patent Number: 4,467,918

[45] Date of Patent: Aug. 28, 1984

[54] LATERAL PACKAGING FOR HOLDING TOGETHER SUPERIMPOSED ARTICLES

[76] Inventor: Michel J. Blot, 6 rue de la Barboire, 85750 Moricq, France

[21] Appl. No.: 387,845

[22] PCT Filed: Oct. 5, 1981

[86] PCT No.: PCT/FR81/00127

§ 371 Date: Jun. 2, 1982

§ 102(e) Date: Jun. 2, 1982

[87] PCT Pub. No.: WO82/01177

PCT Pub. Date: Apr. 15, 1982

[30] Foreign Application Priority Data

Oct. 3, 1980 [FR] France ..... 80 21273

[51] Int. Cl.[3] ..... B65D 65/22; B65D 71/00

[52] U.S. Cl. ..... 206/430; 206/429; 206/526; 206/503

[58] Field of Search ..... 206/429, 430, 434, 501, 206/502, 526, 45.32, 515, 45.31, 431, 427, 462, 465, 503, 504, 505, 158, 140

[56] References Cited

U.S. PATENT DOCUMENTS

| | | | |
|---|---|---|---|
| 2,005,208 | 6/1935 | Schuchat | 206/45.32 |
| 2,173,919 | 9/1939 | Schuchat | 206/45.32 |
| 2,853,186 | 9/1958 | Holmberg | 206/430 |
| 2,996,180 | 8/1961 | Bruce | 206/430 |
| 3,314,532 | 4/1967 | Henry | 206/45.31 |
| 3,784,000 | 1/1974 | Brown | 206/429 X |

FOREIGN PATENT DOCUMENTS

| | | | |
|---|---|---|---|
| 1436935 | 11/1966 | France | 206/431 |
| 7606302 | 12/1977 | Netherlands | 206/502 |
| 1170996 | 11/1969 | United Kingdom | 206/430 |

*Primary Examiner*—Steven M. Pollard
*Assistant Examiner*—Bryon Gehman
*Attorney, Agent, or Firm*—Posnack, Roberts, Cohen & Spiecens

[57] ABSTRACT

Lateral packaging for holding together articles (8, 8*a*, 13, 13*a*) superimposed according to their original orientation.

The lateral band (1) enclosing the periphery of a group of articles (8, 8*a*, 13, 13*a*) presents at least two series of parallel and superimposed slots (7, 7*a*) in which are engaged the angles or the sides (9, 9*a*, 14, 14*a*) of the rims of the articles (8, 8*a*, 13, 13*a*) superimposed according to their original orientation, the said slots (7, 7*a*) being provided in alternate manner on the sides (3, 3*a*) of the band.

The invention is used for the lateral packaging of articles.

8 Claims, 4 Drawing Figures

LATERAL PACKAGING FOR HOLDING TOGETHER SUPERIMPOSED ARTICLES

The present invention relates to a lateral packaging for holding together superimposed articles.

The known packagings of this type are often very complex as regards their assembly and the delicate way they are cut out. Also, the articles are not very safely held together which makes the pack often unsatisfactory as the articles slip and risk to fall. Finally, they also show a printing surface which is too small due to their great number of cut-out portions or, on the contrary, they cover too much of the articles, shielding the upper part thereof and therefore the "sale by" dates, which often necessitates the use of a stick-on label.

Lateral packagings are also known which are constituted by a band which is wrapped around an article and which presents a plurality of notches into which are engaged the rims or flanges of the article to be held in.

The disposition however does not permit to hold a group of articles in such a way that the information printed on the said article is easily readable.

It is the object of the present invention to overcome these disadvantages.

According to the present invention, the lateral band enclosing the periphery of a group of articles is provided with at least two series of superimposed parallel slots into which are engaged the angles or the sides of the rims of the articles superimposed according to their original orientation, the said slots being provided in alternate manner on the sides of the band.

According to another characteristic, the lateral band is octogonal and has eight sides defined by folding lines, one side in two presenting at least two horizontal slots.

This disposition according to the invention permits to efficiently hold all the articles together without any risk of any of them falling off.

Due to its octogonal design and to the easy access to the top and bottom parts of said articles, this packaging offers a maximum visible surface of printing.

In addition, the rigidity of the assembly is exceptional due to the fact that the weight of the articles is distributed on the edge of the slot system.

The octogonal shape of the band makes it possible to present in superimposed manner, groups of articles or products of all shapes, whether square, rectangular, oval or round, without increasing the basic volume, due to the fact that this lateral packaging adopts the shape of the product to be displayed.

Other characteristics and advantages of the invention will be more readily understood on reading the following description of several embodiments, reference being made to the accompanying drawings, in which.

Figure 1:
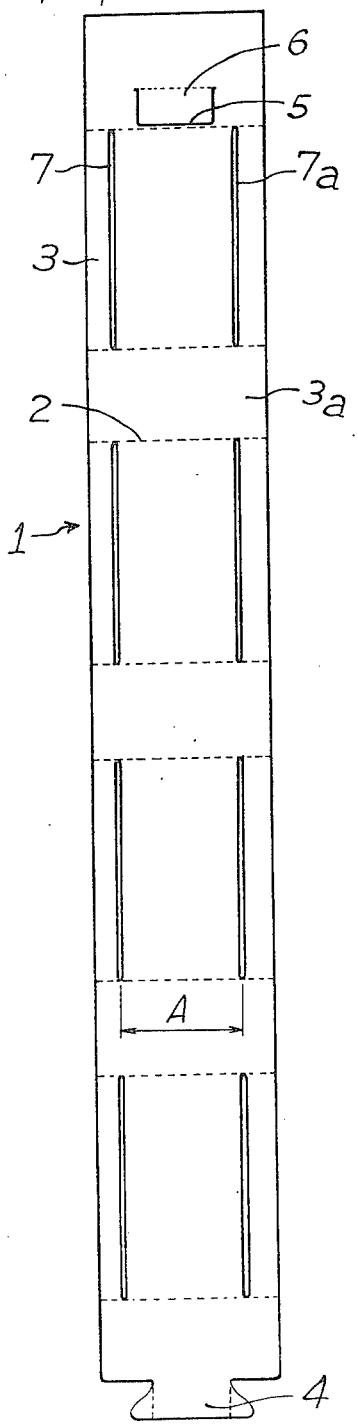
FIG. 1 is a plan view of one embodiment of the packing band according to the invention.

FIG. 1 shows a band 1 in the form of a flat cut-out piece which is constituted of a sheet of cardboard for example, with folding lines 2 to define the sides or faces 3, 3*a*, namely eight in number, to obtain, when the band is assembled by its ends, an octogonal shape.

The assembly means is constituted by a cut-out tab 4, provided at one of the ends of the band, and which is adapted to be engaged in a slot 5 provided at the other end and defined by a cut-out folding tab 6.

On the panels 3 of the band 1, are provided two series of slots 7, 7*a*, which are parallel together and perpendicular to the folding lines 2. The distance A separating two slots 7, 7*a* is equal to the height of an article such as a boat-shaped receptacle 8, 8*a* (FIG. 3).

The slots 7, 7*a* are provided in alternate manner from one side to the other, so that only the sides 3 comprise slots whereas the intermediate sides 3*a* have not.

Figure 3:
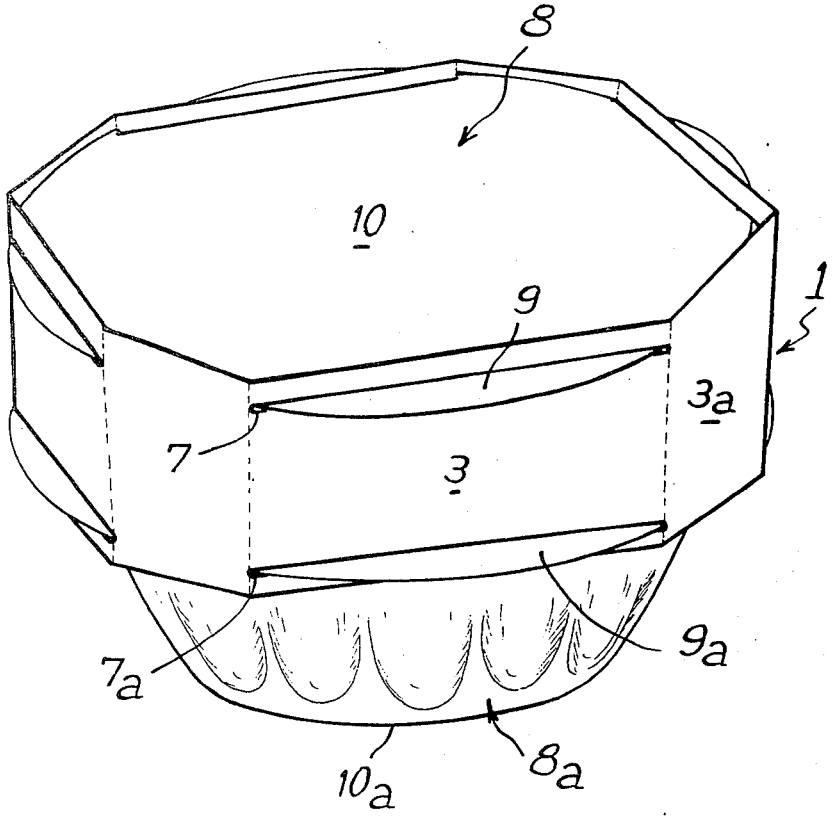
FIG. 3 is a perspective view of the lateral packing member according to the invention, of two tin-foil boat-shaped receptacles.

FIG. 3 shows a band 1 used to join together two receptacles 8, 8*a* stacked one above the other according to their original orientation.

As can be seen in FIG. 3, the edges 9 and 9*a* of the receptacles 8, 8*a* are engaged in the slots 7, 7*a* of the band 1 when the two ends of the latter are assembled and as a result the said receptacles 8, 8*a* are thus held together without any risk of one of them falling.

Moreover, the upper face 10 of the receptacle 8 and the lower face 10*a* of the receptacle 8*a* are visible, this permitting to print information on said faces and in particular the "sell by" date of the product.

Figure 2:
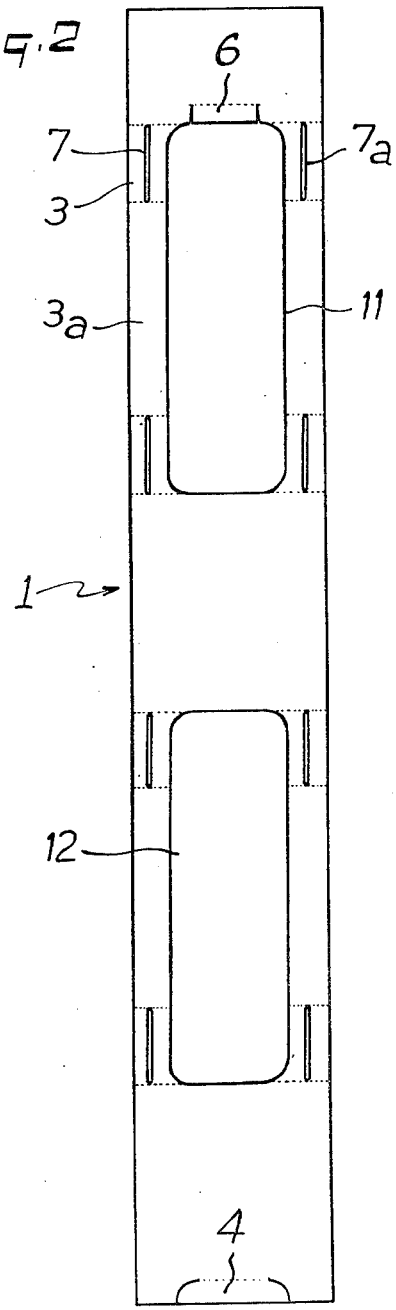
FIG. 2 is a plan view of another embodiment of the band provided with apertures.
Figure 4:
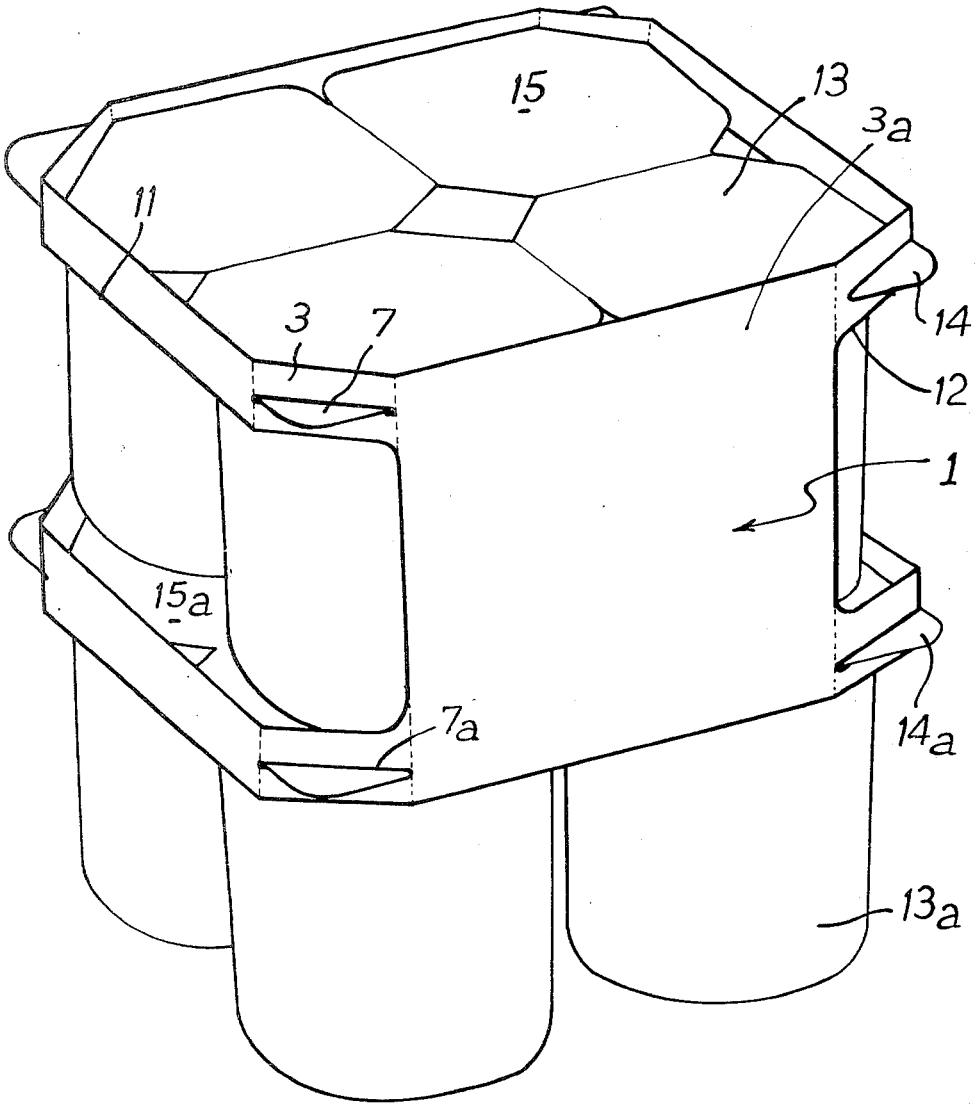
FIG. 4 is a perspective view of the lateral packaging according to the invention of a group of yoghourt containers.

FIG. 2 shows another embodiment of the band 1 wherein apertures 11, 12 are provided which extend over two sides 3 and one side 3*a*. Said apertures are provided in order that the side faces of the articles can be seen, as shown in FIG. 4 where eight yoghourt containers are grouped into two sets of four, 13, 13*a*, superimposed according to their original orientation. One of the angle rims 14 and 14*a* of each yoghourt container 13, 13*a* is engaged in a slot 7, 7*a* of the band 1 so that the containers are held as a unit.

The upper face 15 and 15*a* of the containers 13, 13*a* being externally visible, it is possible to print thereon information which may be read by the user without removing the band.

Although the band which is illustrated comprises two series of slots for assembling two sets of articles, it is quite obvious that the bands can be produced to contain a larger number of slots for assembling a larger number of articles.

Figure 1A:
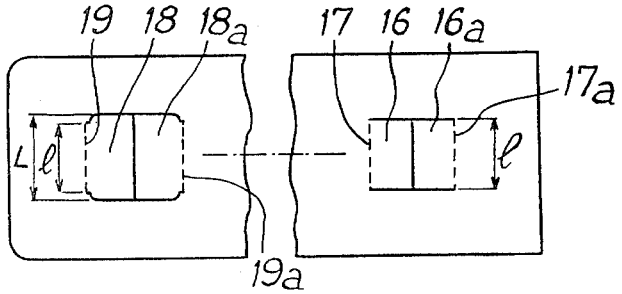

FIG. 1*a* shows another way to assemble the ends of the band 1 wherein one of the ends presents a cut-out part with two flaps 16, 16*a* articulated about the folding lines 17, 17*a*. The other end of the band presents another cut-out portion with two flaps 18, 18*a* of width L greater than the width l of the folding line 19, 19*a* of the flaps 16, 16*a*.

This particular arrangement enables the engagement of the flaps 18, 18*a* of greater width L in the free space left by the flaps 16, 16*a* of smaller width l.

The invention is in no way limited to the description given hereinabove by way of example only, and on the contrary covers any modifications that can be brought thereto without departing from the scope thereof.

I claim:

1. Packaging means for assembling a plurality of articles in superimposed relation with an upper rim of each article disposed uppermost, said packaging means comprising a band of flexible material having opposite ends adapted for being connected together to hold the band around the superimposed articles, said band having at least two sets of slots extending longitudinally along said band in parallel, superimposed relation, said sets of slots being longitudinally spaced along said band to leave solid regions between said slots, said band having fold lines extending perpendicularly to said slots at the edges thereof to form borders for said solid regions, said band being folded at said fold lines in surrounding relation to said articles with said rims of the articles engaged in respective sets of slots to hold said articles in suspended superimposed relation in which the top of the uppermost article and the bottom of the lowermost article are visible, said solid regions of said band forming flat bearing zones abutting against the superimposed articles, said band being provided with apertures in alternating solid regions in a location between the spaced sets of slots.

2. Packaging means as claimed in claim 1 wherein said fold lines are eight in number such that the band is of octagonal shape when folded around said articles, four sides of said band being solid and four sides being provided with said slots.

3. Packaging means as claimed in claim 1 comprising attachment means at said ends of the band including a tab at one end engageable in a cut-out portion at the other end.

4. Packaging means as claimed in claim 1 wherein the spacing between said parallel sets of slots is equal to the height of an article.

5. Packaging means as claimed in claim 1 wherein said apertures extend over the length of the associated solid region and adjacent regions in which said slots are provided.

6. Packaging means as claimed in claim 5 wherein said apertures form strips in said band, said slots being disposed at the ends of each strips.

7. Packaging means as claimed in claim 1 comprising attachment means at said ends of the band including a cut-out portion at each end comprising two flaps articulated about two folding lines, one of the pairs of flaps having a width greater than the width of the other pair of flaps to permit engagement of one of the pairs of flaps into the space left free by the other pair of flaps.

8. Packaging means as claimed in claim 1 wherein the parallel slots in said sets are spaced apart from one another by a distance greater than the spacing of the slots from the respective longitudinal edges of the band.

* * * * *